US005665045A

United States Patent [19]

Brucker

[11] Patent Number: 5,665,045

[45] Date of Patent: Sep. 9, 1997

[54] NINETY DEGREE POURING SPOUT

[75] Inventor: Robert J. Brucker, Barnardsville, N.J.

[73] Assignee: Seal-Spout Corporation, Liberty Corner, N.J.

[21] Appl. No.: 704,962

[22] Filed: Aug. 29, 1996

Related U.S. Application Data

[60] Division of Ser. No. 394,436, Feb. 24, 1995, Pat. No. 5,556,004, which is a continuation-in-part of Ser. No. 30,563, Nov. 1, 1994, Pat. No. Des. 374,400.

[51] Int. Cl.[6] ..... B31B 1/90

[52] U.S. Cl. ..... 493/87; 493/102; 493/103; 29/432; 29/434

[58] Field of Search ..... 493/84, 86, 87, 493/102, 103, 115, 210, 212, 213, 214, 272, 923, 927, 962, 22; 29/432, 434, 773

[56] References Cited

U.S. PATENT DOCUMENTS

| | | | |
|---|---|---|---|
| 2,005,831 | 6/1935 | Shaw | 229/125.04 X |
| 2,318,899 | 5/1943 | Syilwell | 222/531 X |
| 2,442,126 | 5/1948 | Halstead | 222/81 |
| 2,876,933 | 3/1959 | Eyster | 222/531 X |
| 2,892,430 | 6/1959 | Klausmann | 413/53 |
| 3,024,950 | 3/1962 | Frison | 222/531 X |
| 3,381,645 | 5/1968 | Klausmann et al. | 413/53 |
| 3,385,248 | 5/1968 | Klausmann et al. | 413/53 |
| 3,484,034 | 12/1969 | Sternau | 222/531 X |
| 3,523,512 | 8/1970 | Plaesmann | 413/53 |
| 3,690,223 | 9/1972 | Klausmann et al. | 493/87 |
| 3,734,361 | 5/1973 | Brucker et al. | 222/556 |
| 4,072,117 | 2/1978 | Plaesmann | 413/53 |
| 4,583,899 | 4/1986 | Plaesmann | 413/53 |
| 4,806,055 | 2/1989 | Plaesmann | 413/53 |
| 5,022,954 | 6/1991 | Plaesmann | 156/542 |
| 5,088,643 | 2/1992 | Frazier | 493/87 |
| 5,149,392 | 9/1992 | Plaesmann | 156/542 |
| 5,203,819 | 4/1993 | Gleason | 493/87 |
| 5,435,803 | 7/1995 | Owen | 493/87 |
| 5,484,374 | 1/1996 | Bachner | 493/87 |
| 5,556,004 | 9/1996 | Brucker | 222/81 |
| 5,601,669 | 2/1997 | Moody | 493/213 |

*Primary Examiner*—Joseph J. Hail, III
*Assistant Examiner*—Christopher W. Day
*Attorney, Agent, or Firm*—Weingram & Associates, P.C.

[57] ABSTRACT

A spout for a container is provided with depending wings extending down from a bottom edge of the spout. The depending wings terminate in a point for piercing a container. The depending wings permit the spout to pivot ninety degrees from the container to extend from a container at a ninety degree angle therefrom. The spout has side walls with upper edges having arcs of ninety degrees. The spout is inserted into a container with a ram which drives the spout against a ramp to rock the depending wings upward with respect to the bottom edge of the spout. Thereafter, the ram drives the points into the container and the upper edges of the side walls of the spout contact the container and cam the spout back to a horizontal position to insert the ninety degree spout with the depending wings into a container.

6 Claims, 12 Drawing Sheets

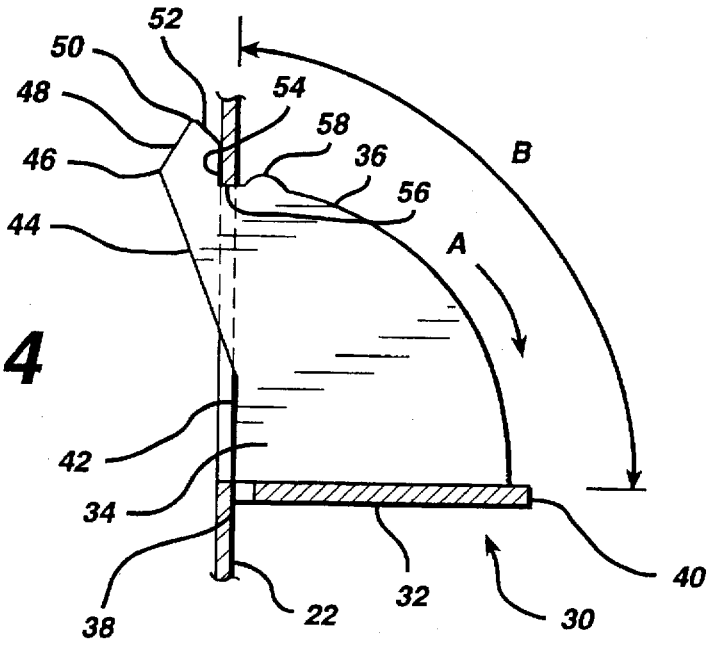
FIG. 4
FIG. 5
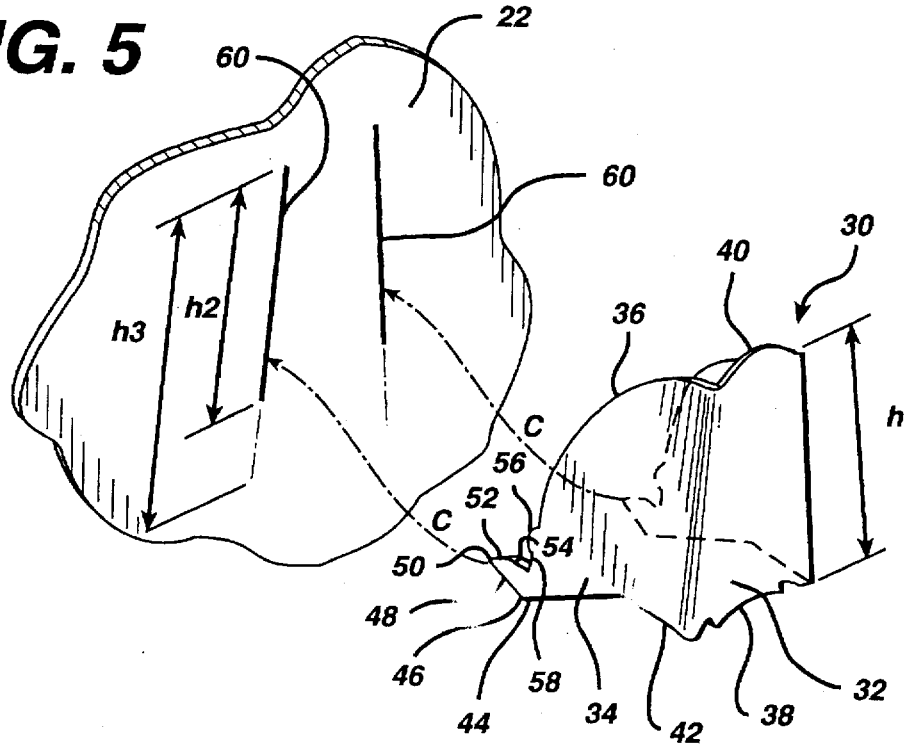

FIG. 15
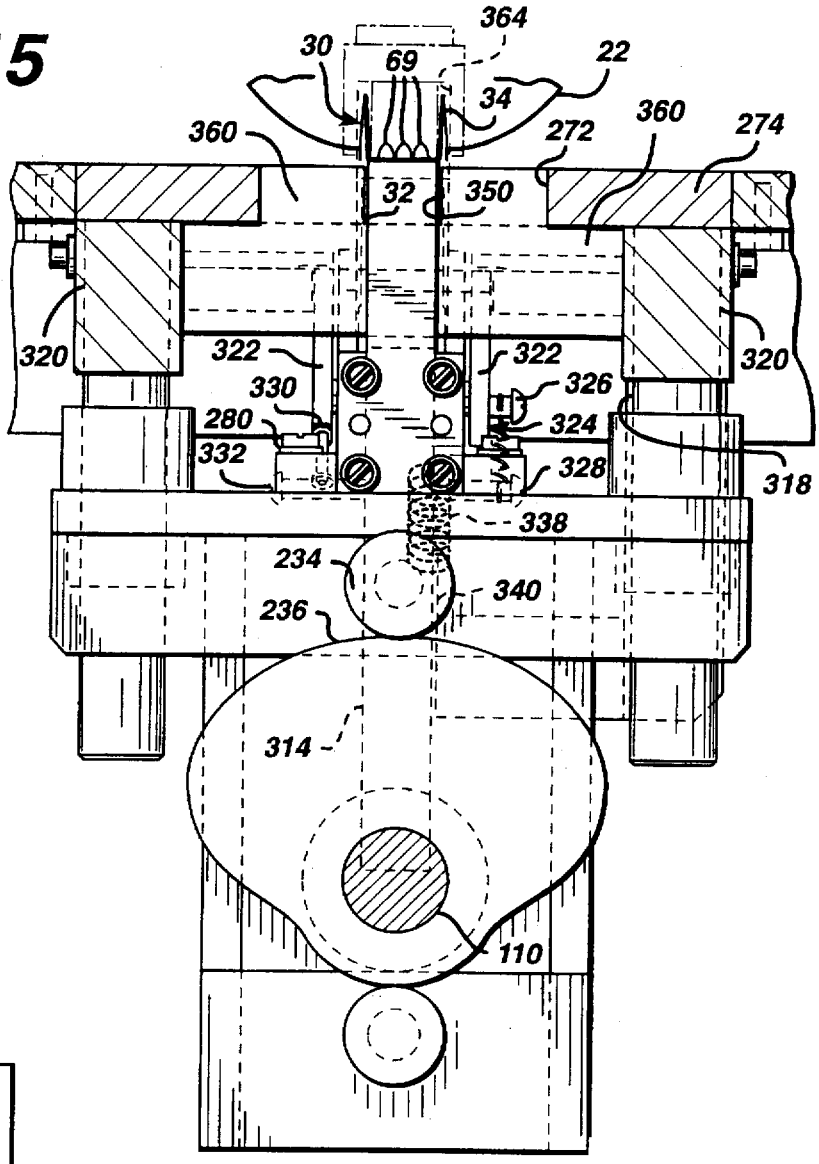
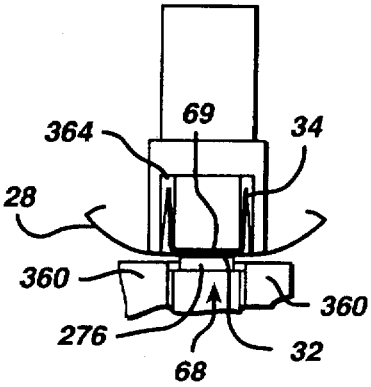
FIG. 17

FIG. 18 PRIOR ART
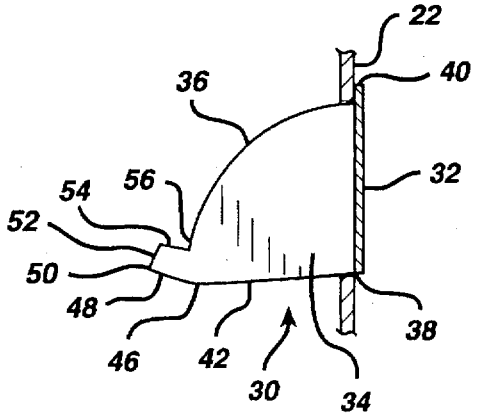
FIG. 19 PRIOR ART
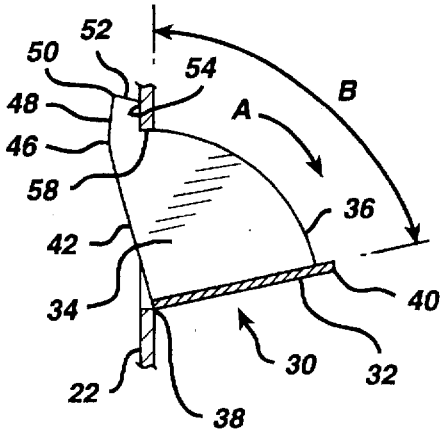
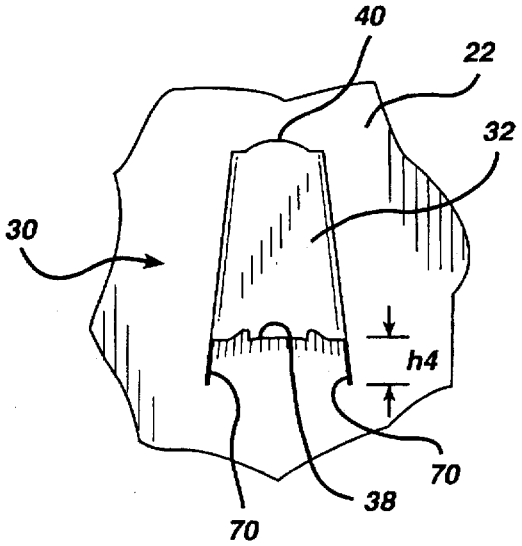
FIG. 20 PRIOR ART
FIG. 21 PRIOR ART
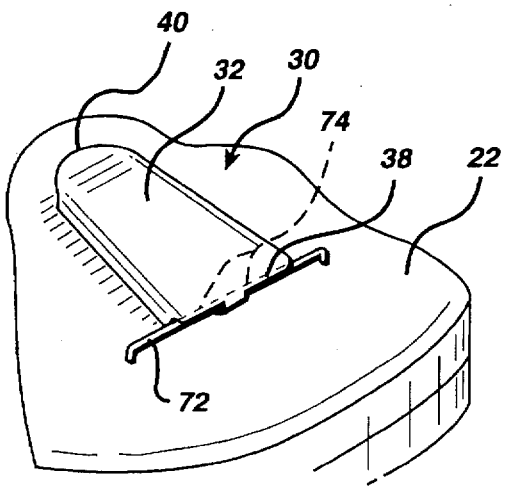

NINETY DEGREE POURING SPOUT

RELATED APPLICATION

This application is a division of application Ser. No. 08/394436 filed Feb. 24, 1995 which application is now: U.S. Pat. No. 5,556,004 which is a continuation-in-part application United States design patent application Ser. No. 29/030,563, filed Nov. 1, 1994, now U.S. Pat. No. D 374,400 entitled NINETY DEGREE SPOUT by Robert J. Brucker, the entire disclosure of which is incorporated herein by reference.

BACKGROUND OF THE INVENTION

1. Field of the Invention

The present invention relates to a pouring spout for a container and more particularly to a pouring spout of a unitary construction capable of fully opening to a ninety degree angle with the container, and a method of inserting such a ninety degree spout into a container.

2. Description of the Prior Art

For dry granular items such as bread crumbs, salt, or other fine powders that are dispensed from boxes or containers, a preferred method of dispensing such granular material is by means of a retractable pouring spout attached to the container.

Machines for inserting spouts into the tops and sides of containers are well known. Such machines exist for placing spouts onto sides of containers and onto round tops of containers. Spouts are usually attached to containers before they are filled. However, whether the spout is placed in the container before or after it is filled, insertion of such spouts requires synchronization between the filling of containers, delivery of the container to the insertion station and insertion of the spouts therein, speed of the assembly line, etc.

Additionally, it is well known in the art to form spouts of a unitary construction which spouts can be stamped, shaped, and then driven into a container in one motion to insert the spout into a container.

However, the spouts of the prior art, of necessity, do not fully open to ninety degrees with respect to the container but rather only at an angle of less than ninety degrees, i.e. 75 to 85 degrees. This is because according to the teachings of the prior art, the bottom edge of the side walls of the spout are positioned at an angle of ninety degrees to the chute. However, part of the ninety degree angle is taken up by the stop means and accordingly, the spouts of the prior art can only open to less than ninety degrees.

It is also known in the art to manufacture spouts which can open to ninety degrees, but such spouts in the past have been cumbersome items including a number parts with movement between the respective parts. For example, it is known to form a spout with a staple attached to the container to provide a rod extending along a surface of the container. The spout is then interconnected with the rod and attached thereto to permit the spout to pivot about the staple. Not only does this spout include a number of parts, it takes a number of steps to properly insert such a spout into a container.

Many devices and process for inserting spouts into caps have been shown in prior U.S. Patents. These efforts include U.S. Pat. Nos. 4,806,055; 4,583,899; 4,072,117; 3,690,223; 3,523,512; 3,385,248; and 3,381,645. All of these patents are incorporated herein by reference. However, none of these patents show the advantages of the present invention.

OBJECTS AND SUMMARY OF THE INVENTION

A primary object of the present invention is to provide a spout for a container, which spout can be opened to ninety degrees with respect to the container.

It is another object of the present invention to provide a method of inserting a spout into a container, which spout is capable of opening ninety degrees with respect to the container.

It is another object of the present invention to provide a method for inserting a ninety degree spout into a container, which punctures slits into the container, which slits are of a height equal to the height of the spout.

It is another object of the present invention to provide a ninety degree spout that can be inserted into a container in a one-step operation.

It is an additional object of the present invention to provide a method for one-step insertion of a ninety degree spout into a container.

It is another object of the present invention to provide a ninety degree spout that can be inserted into a side wall of a container or a top of a container.

It is another object of the present invention to provide a ninety degree spout which can be inserted into a top wall of a round container.

It is another object of the present invention to provide a ninety degree spout that can be locked into a fully-opened position wherein the chute extends from a container at a ninety degree angle.

It is another object of the present invention to provide an apparatus for inserting a ninety degree spout into a container.

It is another object of the present invention to provide an apparatus that includes a ram for pivoting a spout prior to inserting the spout into a container.

These and other objects and advantages of the present invention are accomplished by the method and apparatus of the ninety degree spout of the present invention. The ninety degree spout of the present invention includes depending wings extending down from the bottom edge of the spout. The wings terminate in a point for piercing a container. The depending wings define an angle greater than ninety degrees with respect to the chute. Stop means are formed along the upper edges of the side walls of the spout which permits the spout to open by pivoting about an arc of ninety degrees. The spout is inserted into a container with an apparatus which includes a ram which drives the spout against a ramp to rock the depending wings upward with respect to the bottom edge of the spout. Thereafter, the ram drives the points into the container and the upper edges of the side walls contact the container and cam the spout back a horizontal position. This allows the spout with the depending wings to be inserted into a container through slits that are sized to properly receive and hold the spout in the container.

BRIEF DESCRIPTION OF THE DRAWINGS

Other important objects and features of the invention will be apparent from the following Detailed Description of the Invention taken in connection with the accompanying drawings in which:

FIG. 4 is a side plan view of the spout shown in FIG. 1 in an open position.

FIG. 5 is an exploded perspective view showing the path of the spout shown in FIG. 1 for attachment to the container.

FIG. 15 is a horizontal sectional view taken along line 15—15 of FIG. 13.

FIG. 17 is a fragmentary sectional view through a container showing the ram and anvil of the machine in end elevation.

FIG. 18 is a side plan view of a conventional spout of the prior art.

FIG. 19 is a side plan view of the spout of FIG. 18 in an open position.

FIG. 20 is a front plan view of the spout of the present invention inserted into a container by spout inserting means of the prior art.

FIG. 21 is a perspective view of another prior art spout.

DETAILED DESCRIPTION OF THE INVENTION

Figure 1:
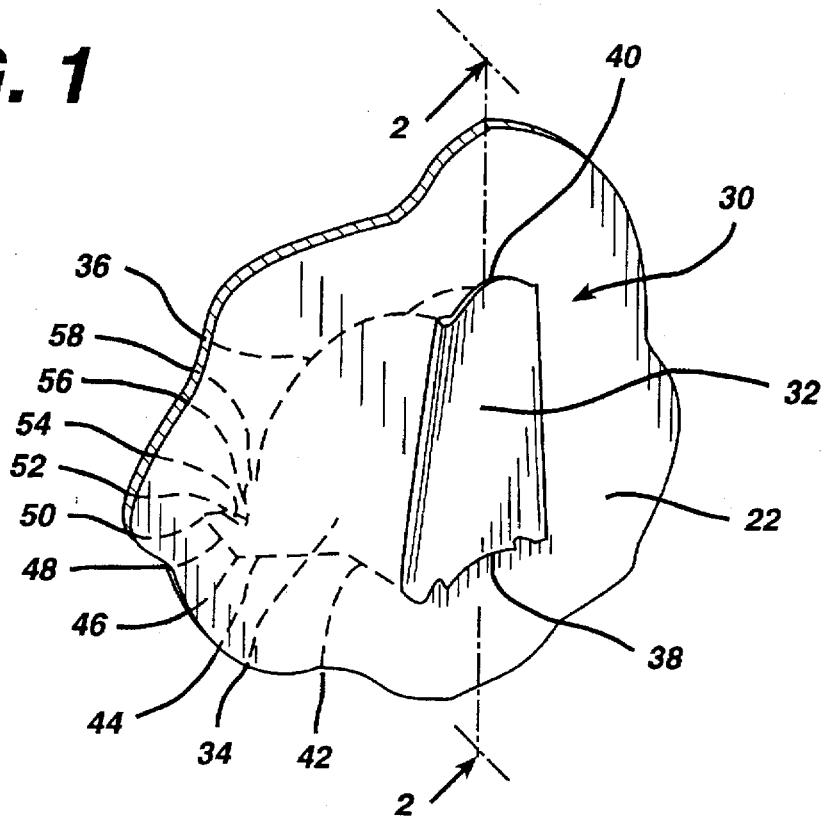
FIG. 1 is a perspective view of the spout of the present invention inserted into a container.
Figure 2:
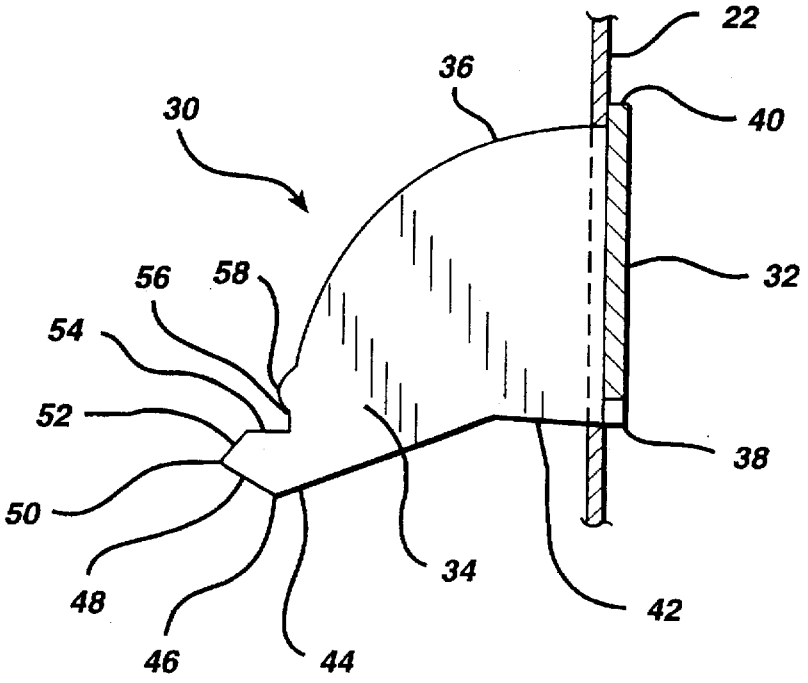
FIG. 2 is a side plan view of the spout shown in FIG. 1.
Figure 3:
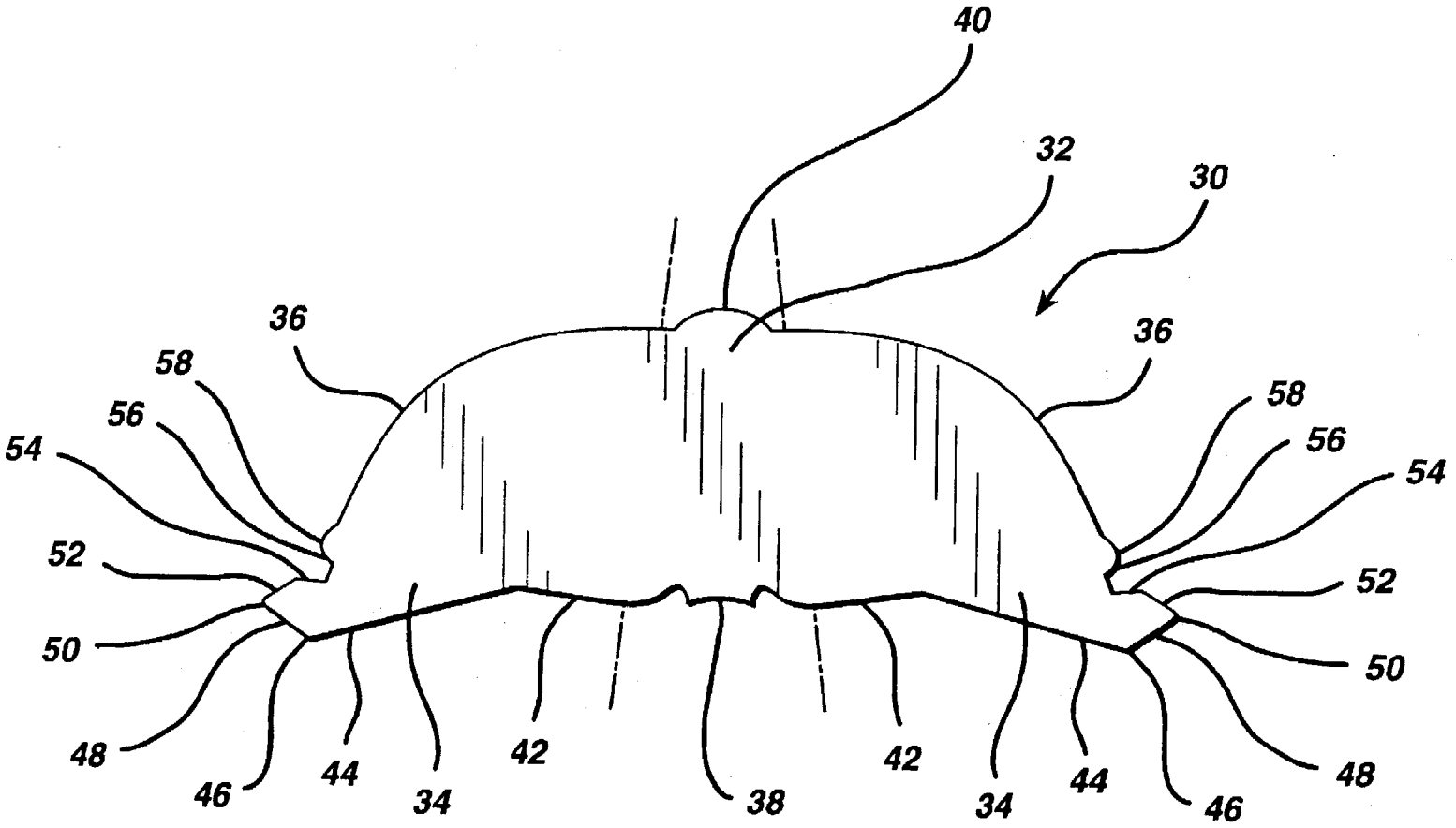
FIG. 3 is a top plan view of a spout blank for forming the spout shown in FIG. 1.
Figure 6:
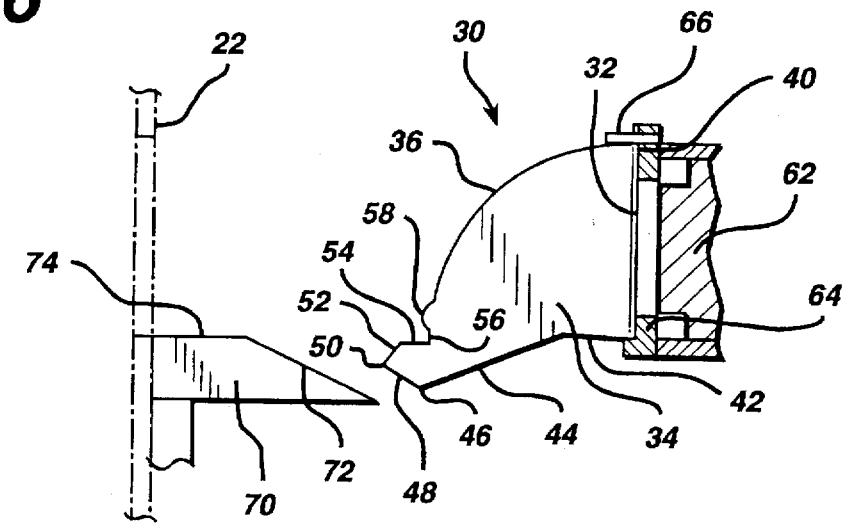
FIG. 6 is a side plan view of the spout shown in FIG. 1 engaged with a ram for insertion into a container.

As shown in FIGS, 1–3, the spout of the present invention is generally indicated at 30. The spout 30 is inserted into a container 22 and coacts therewith to open and close the container 22. Typically, the spout 30 is inserted into a side wall of the container 22, or it may be inserted into the top or other portion of the container. The spout 30 of the present invention may be inserted into a container 22 through slits provided in the container 22 or it may be used to puncture the container 22 to insert the spout 30 into the container 22.

The spout 30 basically comprises a chute 32 and side walls 34. The spout 30 is pivotally attached to the container 22 along a bottom edge 38 of the chute 32. The chute also includes an upper edge 40. The side walls 34 include curved top edges 36 and bottom edges 42 which extend horizontally outward from the bottom edge 38 of the chute 32. Importantly, the spout of the present invention includes depending wings formed as part of the side walls 34. The depending wings include angled bottom edges 44 which extend from the bottom edges 42 to end points 46.

The spout 30 further includes puncture points 50 for piercing a container 22. The puncture points 50 are formed by upper and lower point sides 52 and 48. The lower point sides 48 extend from the end points 46 to the puncture points 50. Upper point sides 52 extend from the puncture points 50 to stop sides 54, which stop sides 54 extend from the upper point sides 52 to the top edges 36 of the side walls 34. The top edges 36 of the side walls 34 further include lock nipples 58 protruding therefrom which form rest positions 56 between the lock nipples 58 and the stop sides 54. Accordingly, when a spout is in a fully opened position, the lock nipples 58 are moved past a wall of a container to lock the spout in an open position.

As shown in FIG. 4, the spout 30, inserted in a container 22, can rotate from a closed position (FIG. 1) to an open position (FIG. 4) by pivoting the spout in the direction of arrow A to open the spout 30 to permit granular material or other material contained in the container to flow from the container 22. The spout 30 is opened by pivoting the spout in the direction of arrow A, the upper edges 36 of the side walls 34 are pivoted out of the container 22 until the lock nipples 58 are moved past the container 22 and the stop sides 54 contact are moved into contact with the container 22. Thus, in the open position, the container 22 is retained in the rest positions 56 of the spout. As can also be seen in FIG. 4 the chute 32 is rotated from the container over an angle of ninety degrees as illustrated by arrow B. Accordingly, the chute 32 of the spout 30 of the present invention extends perpendicular to the container 22 when the spout 30 is in a fully open position.

As shown in FIG. 5, the spout 30 has a height h from the upper edges 36 of the side walls 34 to the bottom edge 38 of the chute 32. Slits 60 are, either formed in the container 22 or punctured in the container 22 during insertion of the spout 30 into the container 22. Preferably, the slits 10 are of an equal height, shown by h2, as the height h of the spout, when the spout 30 is inserted in container 22 along the path of arrow c. Because of the depending wings with angled bottom edges 44, the total height h3 of the spout of the present invention is actually greater than the height of the slits 60. Accordingly, to properly insert the spout 30 into the container 22 the spout must be tilted to enter the container 22 at an angle. The effective height of the spout when tilted is equal to h which is equal to the height of the slit h2.

As shown in FIGS. 5–9, the spout 30 is inserted into a container 22 by means of a ram 62 that travels in the direction of arrow D. The ram 62 engages the shoot 32 of spout 30 and holds the shoot 32 between a bottom 64 and a spring loaded pin 66 at the top. In order to rock the spout 30 to an appropriate angle for insertion into a container 22, a ramp 70 is employed. The ramp 70 is preferably positioned along the container 22. The ramp 70 includes an angled surface 72 and a flat surface 74.

Figure 7:
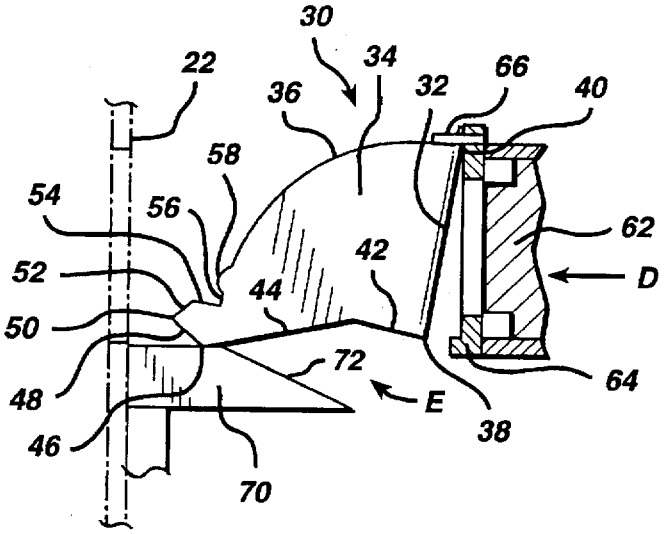
FIG. 7 is a side plan view of the spout shown in FIG. 6 with the ram pushing the spout up a ramp to rock the spout into position for insertion into the container.

In operation, the ram 62 engages the spout 30 and moves the spout 30 in the direction of arrow D. The lower point sides 48 of the spout 30 ride up the angled surface 72 of ramp 70 to a rock the spout 30 along the direction of angle E to a position where the end points 46 are positioned at the same height as the bottom edge 38 of the chute 32, giving the spout an effective height h. This is preferably achieved when the end point 46 of the spout 32 has traveled up the angled surface 72 and onto the flat surface 74 of the ramp 70 as shown in FIG. 7. This positions the points 50 of the spout at a proper location and orientation for insertion into the container 22.

Figure 8:
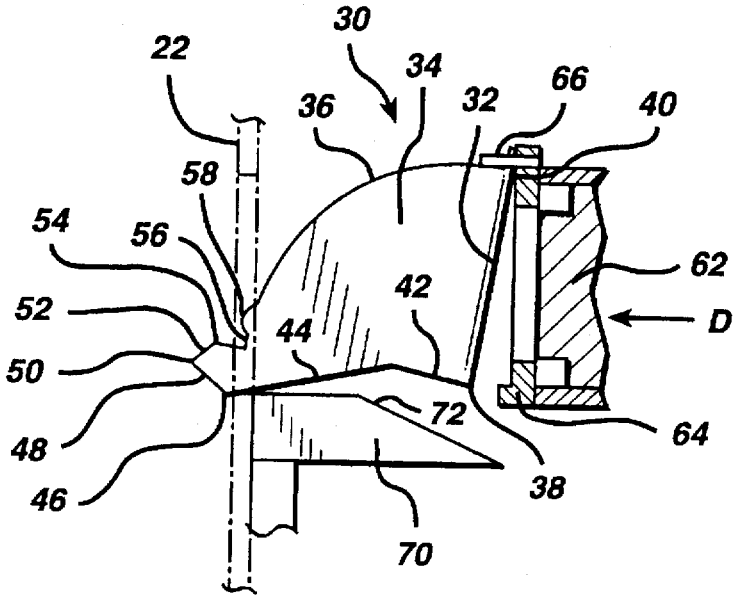
FIG. 8 is a side plan view of the spout shown in FIG. 6 wherein the points of the spout extending into the container.
Figure 9:
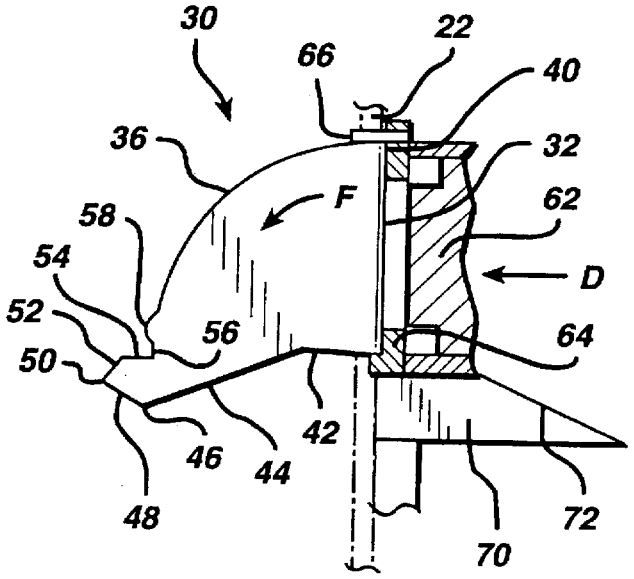
FIG. 9 is a side plan view of the spout of the present invention fully inserted into a container.

Thereafter, as shown in FIGS. 8 and 9, the ram 62 continues to move in the direction of arrow D to drive the points 50 and the spout 30 into the container 22.

As the end 46 of the bottom edge of the spout 30 travels past the ramp 70, the upper surfaces 36 of the side walls 34 of the spout 30 bear against the container 22 to cam the spout 30 in the direction of arrow F to pivot the spout so that the end point 46 of the spout 30 travels downward as the spout is pushed through and into the container 22 by ram 62 traveling in the direction of arrow D to properly seat the spout in the slits formed in the container.

Figure 10:
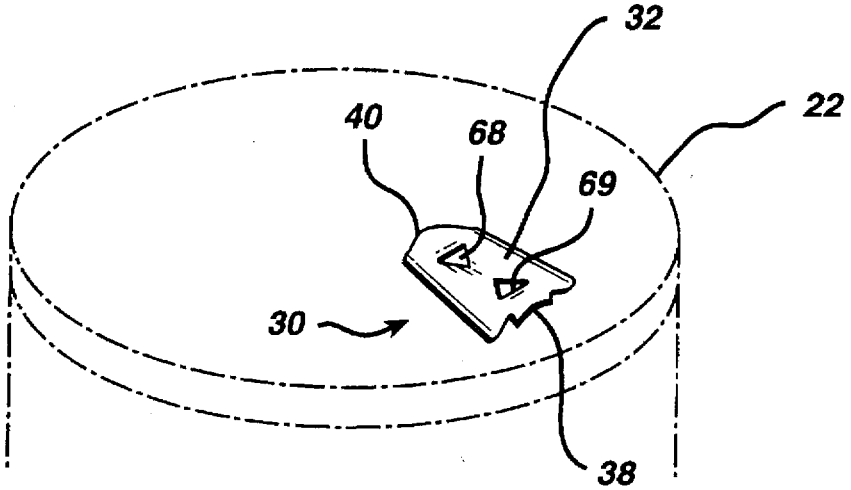
FIG. 10 is a perspective view of a cap of the present invention attached to a top of a round container.
Figure 11:
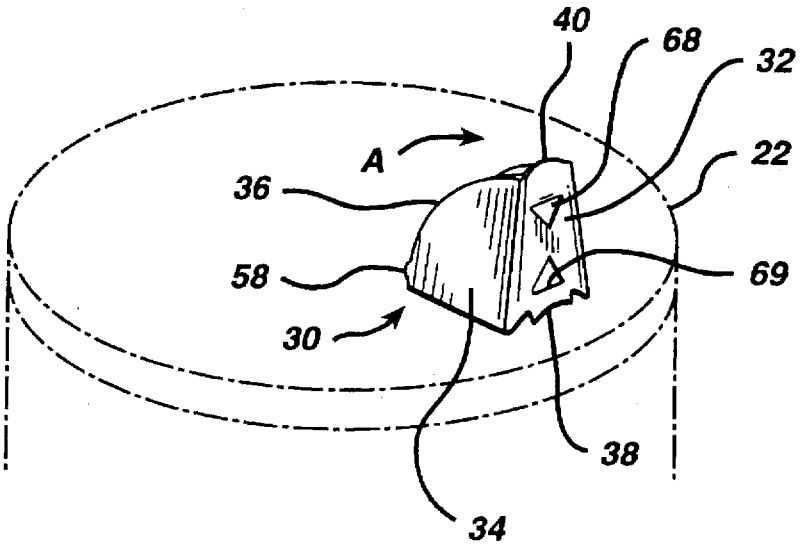
FIG. 11 is a perspective view of the spout of FIG. 10 in an open position.
Figure 12:
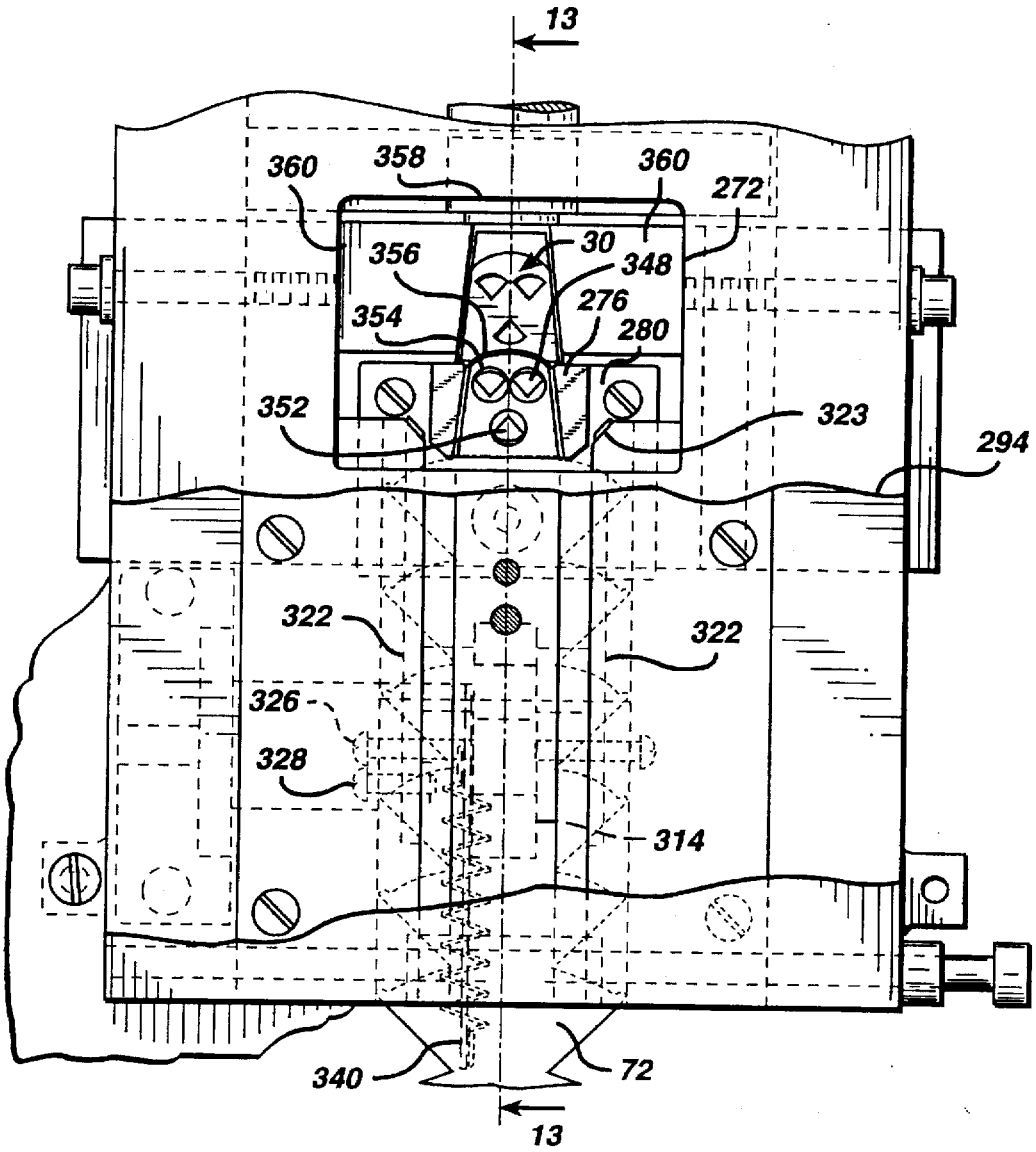
FIG. 12 is a side elevational view of a portion of the spout inserting mechanism, immediately before attachment of the spout to the container, showing a portion of the side plate removed for clearness in illustration.
Figure 13:
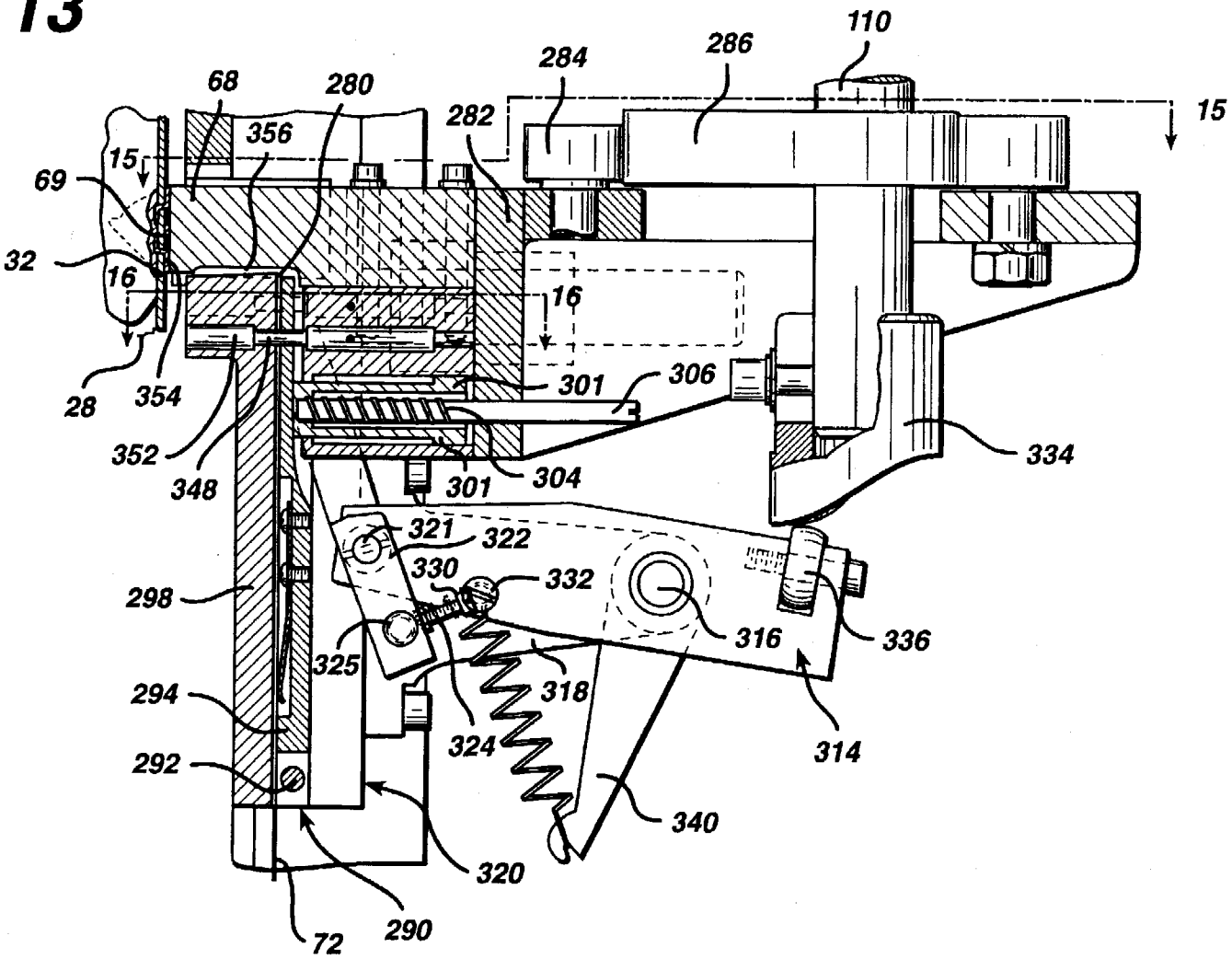
FIG. 13 is a fragmentary vertical sectional view of a spout forming and spout inserting mechanism taken along line 13—13 of FIG. 12 showing the dies and the ram in their respective spout forming and spout inserting position.
Figure 14:
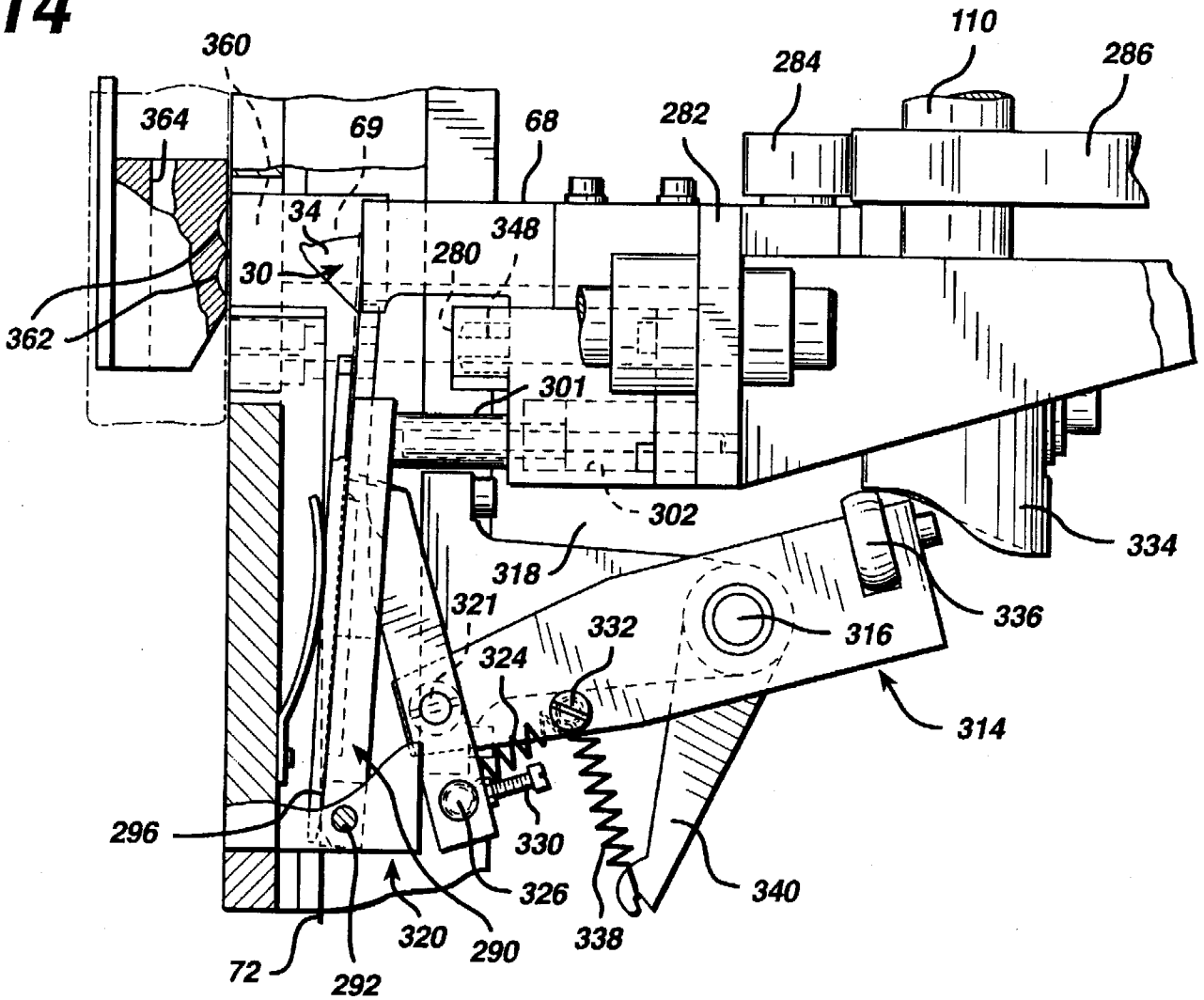
FIG. 14 is an enlarged fragmentary side elevational view of the dies, the ram and the driving devices therefore, showing the movable die and ram in retracted positions.
Figure 16:
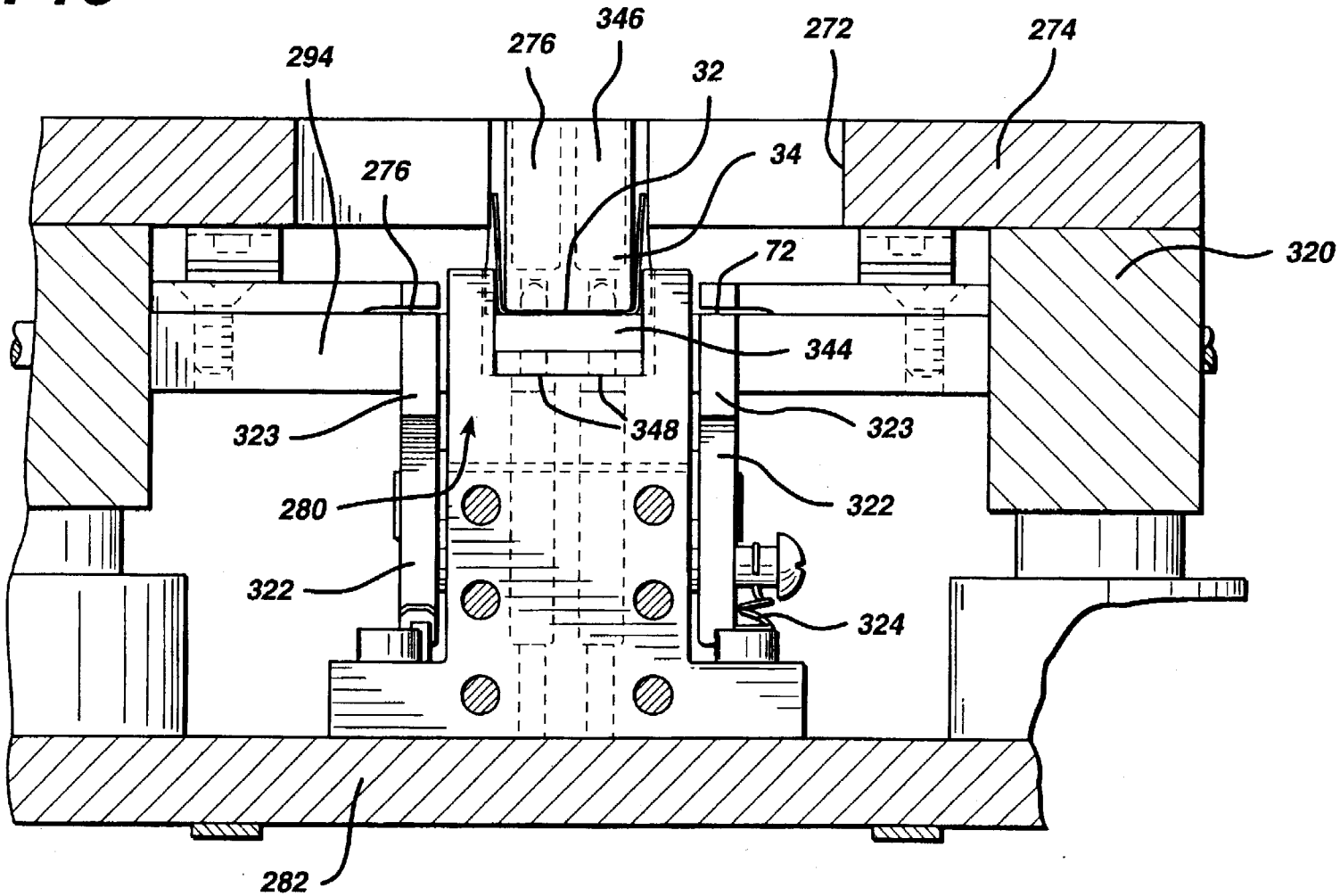
FIG. 16 is a fragmentary transverse vertical sectional view along the line 16—16 of FIG. 13.

As can be understood, the spout of the present invention can be inserted into a container 22, or it can inserted into the top of a round container as shown in FIGS. 10 and 11. Also, as is known in the art, prongs 69 may be introduced into the chute 32 to engage the container 22 so that when the spout 30 is opened by pivoting in the direction of arrow A, a portion of the container 22 engaged with the chute 30 by prongs 69 is rotated in the direction of angle A along with the chute 32 to open the container 22 to permit material contained in the container 22 to be poured from the container.

FIGS. 12 through 17, in which similar numbers to those in the previous FIGURES indicate similar elements, show a spout inserting apparatus, beneath and in alignment with the anvil is a rectangular opening 272 in a ram housing plate 274 and beneath the ram housing plate and in line with said opening is a fixed die 276 and a reciprocable ram 62 which, with the removable die 280 is connected to and moved by a support block 282 that is reciprocable mounted and actuated by rollers 284 on the support block that follows a cam 286 mounted on a drive shaft 110 that is journaled in the upper plate 76.

As shown, preferably the fixed die 276 is formed at one end of a plate 288 that also serves as a part of the spout blank strip feed mechanism generally designated as 290. Pivoted at one end of the plate 288 opposite the fixed dye 276 on a pivot pin 292 is a stripper plate 294 that, with the plate 288, provides a guideway 296 for the spout blank strip 72 and is normally biased away from the plate 288 and carries a leaf spring 298 which serves to yieldingly press the blank strip 72 against the underside of the plate 288 and hold the strip 72 against movement. Adjacent the end of the stripper plate opposite its pivot pin 292 is a plunger 301 slidably mounted in a guide recess 302 in the movable die block and normally influenced against the stripper plate by a compression spring 304 that is held in position by a guide rod 306, one end of which is connected to the plunger 300 while the other end is slidably mounted in the support block 282.

During the operation of the machine, a spout blank strip 72 is fed step-by-step from a suitable supply such as a reel 70 journaled on the reel bracket frame to the dies and the ram. This strip of spout blanks is shown in including a plurality of spout blanks connected in end-to-end relation, each blank being shaped to provide the chute 32 and side walls 34 of the finished spout The strip of blanks is fed by a mechanism comprising a lever 314 pivotally mounted intermediate its ends at 316 on a bracket arm 318 connected to a frame bar 320 secured to the housing plate. Pivotally connected to the end of the lever 314 on a common pivot pin 321 are a pair of feed dogs 322 the upper ends of which have inturned fingers 323 to engage behind the edges of the respective blanks of the blank strip. The feed dogs are normally influenced into feeding relation to the blank strip by a tension spring 324 one end of which is connected to a pin 326 on the feed dogs while the other end is connected to a screw 328 secured in the lever 314. Preferably an adjustable stop screw 330 is threaded into one of the dogs to abut another screw 332 coaxial with the screw 328 for limiting movement of the feed dogs in one direction under the influence of the spring 324.

The lever 314 is actuated by a feed cam 334 adjustable on the drive shaft 110 and followed by a follower roller 336 journaled on the lever 314. The roller 336 is normally held in contact with the cam by a spring 338 one end of which is connected to the screw 328 while its other end is connected to an arm 340 rigidly connected to the lever 314.

During operation of the machine, the container 22 is positioned in the arms of plate 134 and anvil block 27 is reciprocally brought downwards behind the container 22 by the action of barrel cam. The lever 314 is actuated by the cam 334 to reciprocate the feed dogs 322 and feed the blank strip 72 step-by-step so that at the end of each step a blank is brought onto position between the dies 276 and 62 for completing the formation of the spout 30, and a completed spout 30 is positioned with respect to the anvil. While the spout blank is at rest, the cam 286 moves the support block 282 to move the lower die 280 into coactive relation to the upper die 276 to complete the spout by bending the side walls 34 upwardly from the chute 32 and by forming prongs 69 for fastening the spout to the container 22. The lower side is formed with a channel 344 which coacts with a forming block 346 on the upper die for producing the side walls 34, and the prongs 69 are formed by punches 348 secured in the lower die, which pass loosely through openings 350 in the stripper plate 294 and into the die holes 352. The support block 282 is then pushed by the cam 286 so that the punches 348 are withdrawn from the spout blank and the stripper plate which strips the spout 30 from the punches, and the blank strips 72 are permitted to swing away from the upper dies as shown in FIG. 8.

Simultaneously with the formation of one spout 30, the ram 62 is moved, and the next preceding spout, that is, the spout at the leading end of the blank strip 72 is severed from the strip between blade edges 354 and 356 that are carried by the ram and the upper die, respectively. After severing the spout from the strip, the ram 68 pushes the spout 30 through a guide channel formed by the fixed die and the spaced apart end surfaces 358 of guide blocks 360. The ram 68 forces the side walls 34 and prongs 69 of the spout 30 through the container 22 which is pressed against the anvil 270. The face of the anvil preferably has depressions 362 to deflect and cinch the prongs 69. The anvil, of course, has grooves 364 to provide a clearance for the flanges as the latter penetrate the wall of the container 22. After the spout 30 has been inserted into and secured in the container 22, the anvil 270 is withdrawn from the web as described above.

As can be seen by one skilled in the art, any suitable spout inserting method and apparatus can be used for inserting the spout of the present invention into a container 22. Such methods and apparatus may be used for inserting the spout 30 of the present invention into a cap for a container 22 or directly into a container 22 along sides thereof.

FIG. 18–21 show various embodiments of the prior art spouts in this area. As shown in FIG. 18, the conventional spout includes many of the elements of the spout of the present invention but, importantly, has a horizontal bottom wall 42 extending along the entire lower end of the spout. This provides a spout, which when opened by pivoting in the direction of arrow A (FIG. 19) opens at an angle less than ninety degrees as indicated by angle B. Further, as shown in FIG. 20, the spout of the present invention cannot be inserted into a container 22 by conventional spout inserting means, without a ramp or other means used in connection with a spout inserting means because the angled bottom edge 44 extends down from the bottom edge 38 of the chute 32. If the spout of the present invention were inserted into a container 22 without means for rocking or camming the point up, elongated slits 70 would be formed during entry of the point, the point 50 of lower point edge 48 and end 46 and the angled wall 42. These extra slits 70 would extend a distance indicated as h4 down from the bottom edge of the spout during the insertion process. This would result in a spout that would be sloppy and unstable and can easily be withdrawn from engagement with the container.

Other attempts to provide a spout that opens to ninety degrees has resulted in complicated spouts with extra parts as shown in FIG. 21. The spout 30 and 21 is attached to a container 22 by means of a staple 72. The staple is inserted into the container 22 and anchored thereto. A spout 30 is interconnected with the container by a tab 74 extending from the bottom edge 38 of the shoot 32. Tab 74 is wrapped around the staple to permit the spout to pivot about the staple 72. Inserting such spout is a cumbersome process and requires a number of steps to be performed in order to insert the spout into a container. In contrast, the spout of the present invention allows for a spout to be inserted into the container, in a one step operation, and still permits the spout to open to ninety degrees.

Modifications of the foregoing may be made without departing from the spirit and scope of the invention. What is desired to be protected by Letters Patents is set forth in the appended claims.

What is claimed is:

1. An apparatus for inserting a spout into a container comprising:

spout blank supply means for supplying spout blanks to be formed into respective spouts, spout forming means for forming a spout from a respective spout blank, said spout having:

a central chute section having a chute height for being inserted into a container surface of the container, first and second side walls extending from the central chute section of the spout, the first and second side walls each comprising curvilinear upper surfaces for pivoting the central chute section between a closed position and an open position with respect to the container surface, first and second depending wings extending from the respective first and second side walls, defining a total spout height greater than the chute height and an slit height such that the central chute section is pivotable between the open position and the closed position with respect to the container surface;

ram means for engaging a spout and driving it into a container toward said container surface;

positioning means, attached to said ram means, for positioning the spout on said ram means, the positioning means comprising a spring loaded pin for engaging an upper edge of a spout to hold a spout in a desired position with respect to the ram means such that the spout is pivotable about said upper edge of said spout;

orientation means in cooperation with said positioning means for orienting the spout means to pivot about said upper edge to a desired orientation defining an angle relative to said ram direction for inserting the spout into a container surface, the orientation means having:

an angled ramp surface defining said angle relative to said ram direction for pivoting the spout; and a flat ramp surface interconnecting the container surface and the angled ramp surface for defining an angle substantially parallel to said ram direction along which the spout is driven by the ram means for inserting the spout into the container surface; and support means for supporting a container for spout insertion.

2. An apparatus for inserting a spout into a container comprising:

spout providing means for providing a spout having:

cam means formed integral with the spout for camming the spout between an open position and a closed position with respect to a container surface of the container, and a total spout height greater than a slit height of the container surface for inserting the spout into the container such that the spout is pivotable between said open position and said closed position;

ram means for engaging a spout and driving it into said container surface;

orientation means for orienting the spout to a desired angle relative to said ram direction for inserting the total spout height into said slit height of the container surface; and support means for supporting a container for spout insertion.

3. The apparatus of claim 2 wherein the orientation means comprises a ramp constructed and arranged for rocking the spout to a desired orientation at an angle relative to said ram direction for inserting the total spout height into said slit height of the container surface.

4. The apparatus of claim 3 further comprising a spout forming means for forming a said spout from a respective spout blank.

5. The apparatus of claim 4 wherein the ram means comprises a spring loaded pin for engaging an upper edge of the spout to hold the spout in a desired position with respect to the ram means such that the spout is pivotable about said upper edge of said spout.

6. The apparatus of claim 5 wherein the ramp comprises an angled ramp surface and a flat ramp surface, the angled ramp surface defining said angle relative to said ram direction for pivoting the spout to a proper angle for inserting the spout into the container, the flat ramp surface defining an angle substantially parallel to said ram direction for maintaining the angle of the spout.

* * * * *